US006599040B2

(12) United States Patent
Nakazawa et al.

(10) Patent No.: US 6,599,040 B2
(45) Date of Patent: Jul. 29, 2003

(54) METHOD OF SETTING A PRINT START POSITION IN A CONTINUOUS FORM PRINTING SYSTEM

(75) Inventors: Souichi Nakazawa, Ibaraki (JP); Atsushi Miyamoto, Ibaraki (JP); Masahiro Mizuno, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/058,093

(22) Filed: Jan. 29, 2002

(65) Prior Publication Data

US 2002/0131804 A1 Sep. 19, 2002

(30) Foreign Application Priority Data

Mar. 16, 2001 (JP) ..... P2001-075189

(51) Int. Cl.[7] ..... B41J 21/16; G03G 15/00
(52) U.S. Cl. ..... 400/282; 101/179; 399/384
(58) Field of Search ..... 400/282, 188, 400/582, 279; 101/179, DIG. 46; 399/384

(56) References Cited

U.S. PATENT DOCUMENTS 5,150,560 A * 9/1992 Crowley ..... 53/411
5,548,390 A * 8/1996 Sugisaki et al. ..... 399/364
5,905,930 A * 5/1999 Toyama et al. ..... 399/299
6,056,180 A * 5/2000 Crowley et al. ..... 226/31
6,305,857 B1 * 10/2001 Crowley et al. ..... 400/579
6,375,296 B1 * 4/2002 McGarry et al. ..... 347/13
6,381,440 B1 * 4/2002 Bock et al. ..... 399/384
2001/0021027 A1 * 9/2001 Ueno et al. ..... 358/1.1
2002/0081132 A1 * 6/2002 Miyamoto et al. ..... 399/384
2003/0015564 A1 * 1/2003 Crowley et al. ..... 226/31

FOREIGN PATENT DOCUMENTS

JP 04239668 A * 8/1992 ..... B41J/11/42
JP 2000206852 A * 7/2000 ..... G03G/21/14

OTHER PUBLICATIONS

English translation of JP 2000206852 A by the JPO website automated translator performed on Jan. 24, 2003.*

* cited by examiner

*Primary Examiner*—Charles H. Nolan, Jr.
(74) *Attorney, Agent, or Firm*—McGinn & Gibb, PLLC

(57) ABSTRACT

In a print position setting method, a sequence of the following operations of printing a toner mark 4 by the obverse side printer, of detecting the toner mark 4 by a mark sensor 9, and feeding a printing sheet a distance ranging from a toner mark detecting position 12 to a page leading edge position 6 when the printing operation starts, is automated.

1 Claim, 3 Drawing Sheets

METHOD OF SETTING A PRINT START POSITION IN A CONTINUOUS FORM PRINTING SYSTEM

BACKGROUND OF THE INVENTION

1. Field of the Invention

The present invention relates to a method of setting a print start position in a continuous form printing system such that when the printing system operates in a both-side print mode, the leading edge of a first page of the obverse side of a printing sheet of paper, which is printed by an obverse side printer, is matched to the leading edge of a first page of the reverse side of the printing sheet, which is to be printed by a reverse side printer.

2. Description of the Related Art

FIG. 1 is a view showing a sheet 1 with perforated folds. FIG. 3 is a perspective view showing how to set a print start position by use of a perforated fold 3. The setting of the print start position in the continuous form printing system will be described with reference to FIGS. 1 and 3.

A sheet position used when the printing operation starts is set in a manner that a perforated fold 3 or a toner mark 4 is set, by the eye, at a division 7 on a scale, which is representative of a print start position. The sheet position may also be set in the following manner. A leading edge 11 of a printing sheet as cut off along a perforated fold is detected by a sensor 14. The printing sheet is fed forward a specific distance from a position where the leading edge 11 is detected, and the perforated fold 3 is set at a page leading position 6 from which the printing operation will start.

FIG. 5 is a diagram showing a both-side printing system using a continuous form printing system. In the printing system, two printers are connected in series so that those printers print on a continuous form continuously, and a sheet reversing device 10 for reversing a surface of the continuous form from one side to the other is provided between those printers. In the case of a printing sheet 2 not having perforated folds, a page position is not fixed physically. Accordingly, the printing operation may start from a desired position. To print on both sides of the printing sheet 2 not having perforated folds, it is necessary to match a print position on the reverse side of a page of a printing sheet, which contains something printed on an appropriate location on the obverse side thereof, to a printing position on the obverse side of the page. The leading edge of the printing sheet 2 not having perforated folds is not fixed in position relative to the printing position. Accordingly, it is impossible to use the print start position matching method based on the leading edge detection of the paper. For this reason, the print start positions must be matched to each other by the eye and manual. However, the use of the eye results in an unsatisfactory accuracy of the print start position matching, and the matching operation by manual is unsatisfactory in operability.

BRIEF DESCRIPTION OF THE PREFERRED EMBODIMENTS

SUMMARY OF THE INVENTION

The present invention has been made under the above circumstances, and therefore an object of the present invention is to provide a high accuracy of the print start position matching and a good operability in the matching operation by automating the setting of the print start position for the reverse side printer.

The above object is achieved by automating a sequence of operational events from a printing operation for the obverse side of a printing sheet, a detecting operation of a toner mark, and an operation of feeding the printing sheet a predetermined distance.

DETAILED DESCRIPTION OF THE PREFERRED EMBODIMENTS

Figure 1:
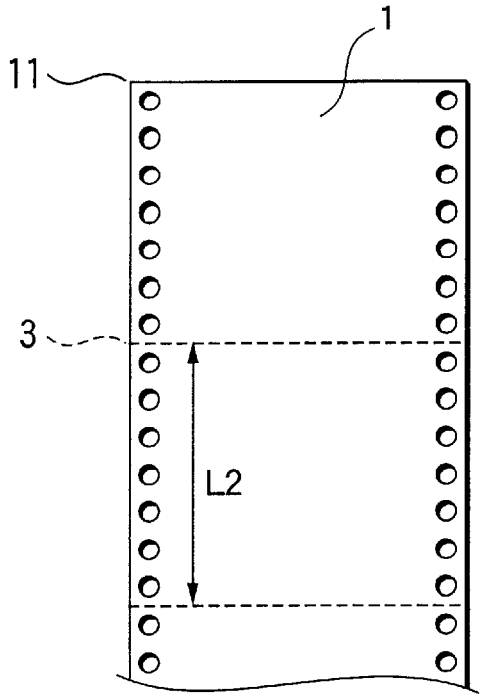
FIG. 1 is a plan view showing a printing sheet with perforations.
Figure 2:
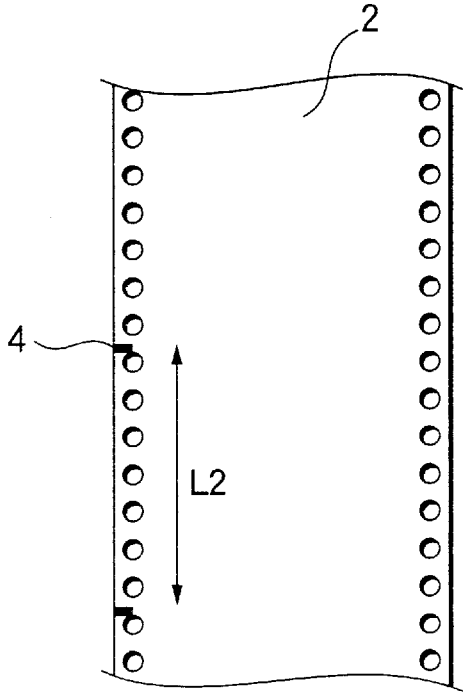
FIG. 2 is a plan view showing a printing sheet with no perforations.
Figure 3:
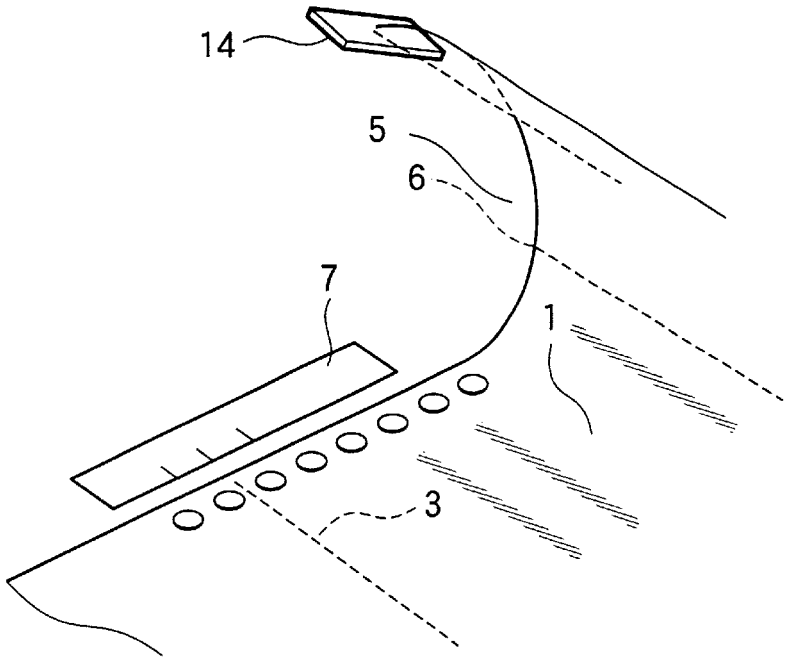
FIG. 3 is an explanatory diagram showing a procedure of setting a print start position by using the perforations of the printing sheet.
Figure 4:
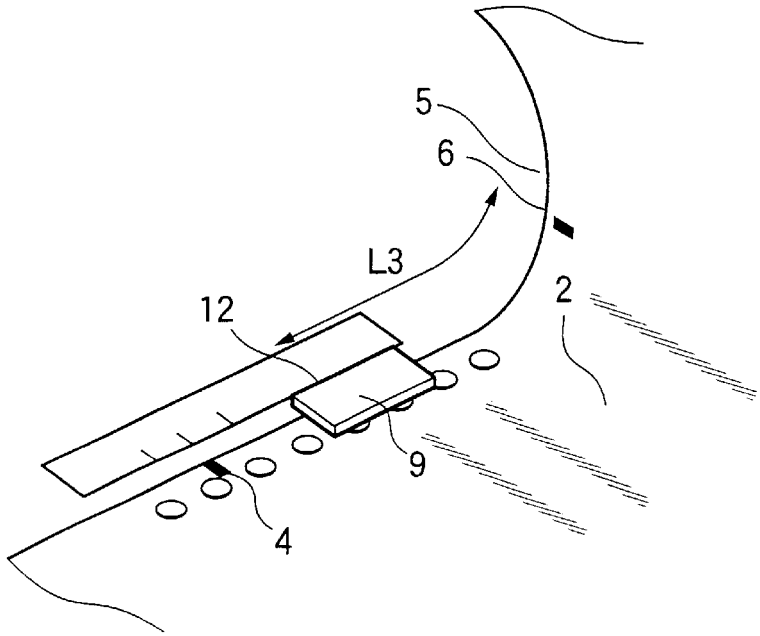
FIG. 4 is an explanatory diagram showing a procedure of setting a print start position by using a mark sensor.
Figure 5:
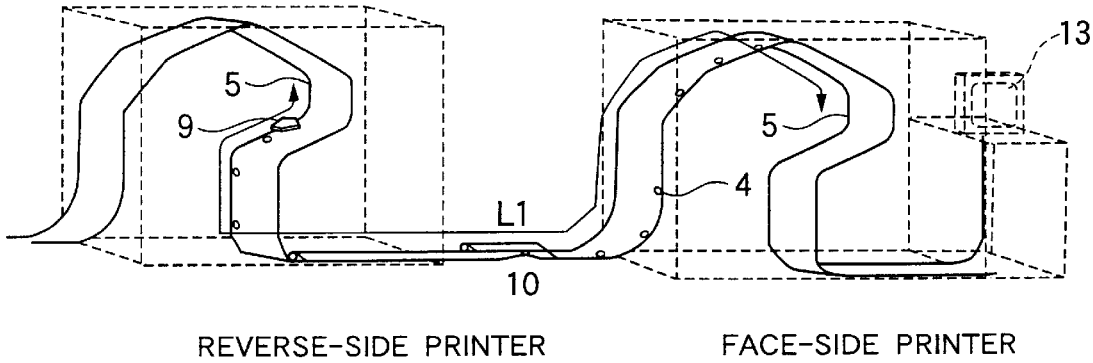
FIG. 5 is a diagram showing an overall both-side printing system.

The preferred embodiment of the present invention will be described with reference to FIGS. 4 and 5. By depressing a switch 13 which is provided on the printer or a controller, the obverse side printer prints a toner mark 4 on a page leading part of the printing sheet, and the reverse side printer feeds the printing sheet without printing operation.

When the toner mark 4, which is printed on the first page of the printing sheet by the obverse side printer, is transported and reaches a position before the mark sensor 9, which is mounted on the reverse side printer, the printing and the sheet feeding operations are suspended. The number of printed pages Pc1 printed by the obverse side printer is mathematically expressed by $$Pc1 \geqq L1/L2,$$

where L1: path length of the sheet from a printing position 5 of the obverse side printer to that of the reverse side printer (L1 determined when the printers are installed.)

L2: length of one page.

The number of pages Pc2 fed by the reverse side printer is expressed by $$Pc2 \geqq Pc1 - L3/L2,$$

where L3: path length from print start position 6 of the reverse side printer to a position 12 where a toner mark is detected.

Subsequently, in the printing system, a sheet feeding operation for detecting the toner mark 4 by the mark sensor 9, is performed only in the reverse side printer. The paper feeding is stopped after it is transported from a position where the toner mark 4 is detected, by a distance of a path length Lb ranging from the print start position 6 of the reverse side printer to the toner mark detecting position 12. Through the above operation, an automatic print start position setting is possible.

As seen from the foregoing description, the present invention is capable accurately and easily setting a print start position for the reverse side printer even in the case of the both-side printing on the printing sheet not having perforated folds. Additionally, even when the printing paper having the perforated folds or the pre-printed paper having toner marks printed thereon is used, the printing operation will efficiently be performed if the present invention is utilized.

What is claimed is:

1. A method of setting a print start position in a continuous form printing system having a mark sensor for detecting a toner mark printed at a specific position on a printing sheet of paper and a switch for triggering a print-start-position setting operation, said method comprising the steps of:

starting the printing of the obverse side of said printing sheet by depressing said switch when said continuous form printing system is in a both-side print mode;

stopping the printing operation in said continuous form printing system when the printing of a specific number of pages of said printing sheet has been performed before a first page of the obverse side of said printing sheet reaches a mark sensor of a reverse side printer;

starting the transporting of said printing sheet in said reverse side printer;

detecting said toner mark pre-printed at a specific position on a first page of said printing sheet by said mark sensor; and transporting said printing sheet a specific distance measured from a position where said toner mark is detected.

* * * * *